US008517000B2

(12) United States Patent
Rowland

(10) Patent No.: US 8,517,000 B2
(45) Date of Patent: Aug. 27, 2013

(54) FUEL TREATMENT DEVICE USING HEAT AND MAGNETIC FIELD

(76) Inventor: Wayne Rowland, Rainier, WA (US)

( * ) Notice: Subject to any disclaimer, the term of this patent is extended or adjusted under 35 U.S.C. 154(b) by 257 days.

(21) Appl. No.: 12/998,109

(22) PCT Filed: Sep. 14, 2009

(86) PCT No.: PCT/US2009/005135

§ 371 (c)(1),
(2), (4) Date: May 12, 2011

(87) PCT Pub. No.: WO2010/033171

PCT Pub. Date: Mar. 25, 2010

(65) Prior Publication Data

US 2011/0226221 A1 Sep. 22, 2011

Related U.S. Application Data

(60) Provisional application No. 61/192,351, filed on Sep. 18, 2008, provisional application No. 61/208,850, filed on Feb. 27, 2009.

(51) Int. Cl.

| | |
|---|---|
| ***F02G 5/00*** | (2006.01) |
| ***F02B 51/00*** | (2006.01) |
| ***F02M 27/00*** | (2006.01) |

(52) U.S. Cl.
USPC ..... 123/543; 123/536; 123/538; 123/557

(58) Field of Classification Search
USPC ..... 123/536–543
See application file for complete search history.

(56) References Cited

U.S. PATENT DOCUMENTS

| | | | | | |
|---|---|---|---|---|---|
| 3,349,354 | A * | 10/1967 | Miyata | 335/209 |
| 4,155,337 | A * | 5/1979 | Hensley | 123/541 |
| 5,076,246 | A * | 12/1991 | Onyszczuk | 123/538 |
| 5,127,385 | A * | 7/1992 | Dalupin | 123/538 |
| 5,161,512 | A * | 11/1992 | Adam et al. | 123/538 |
| 5,257,609 | A * | 11/1993 | Reed et al. | 123/557 |
| 5,411,005 | A * | 5/1995 | Bohl et al. | 123/557 |
| 5,637,226 | A * | 6/1997 | Adam et al. | 210/695 |
| 6,056,872 | A * | 5/2000 | Glass | 210/223 |
| 6,474,316 | B1 * | 11/2002 | Yamaguchi | 123/538 |
| 6,892,709 | B2 * | 5/2005 | Hopley | 123/502 |
| 7,004,153 | B2 * | 2/2006 | Lisseveld | 123/538 |
| 7,389,753 | B1 * | 6/2008 | Lee | 123/3 |
| 7,487,764 | B2 * | 2/2009 | Lee | 123/538 |
| 2001/0025631 | A1 * | 10/2001 | Beekman et al. | 123/557 |

* cited by examiner

*Primary Examiner* — Lindsay Low
*Assistant Examiner* — Tea Holbrook

(57) ABSTRACT

A fuel enhancer device provides a substantially higher miles per gallon gas saving of at least ten (10) miles per gallon for motor vehicles powered by fuel-injected, internal combustion engines. The device pre-heats the fuel, and subjects the fuel to a magnetic field, prior to the fuel's entry into the engine fuel injectors. The device is simple to install within a fuel line system next to an engine's bank of fuel injectors.

26 Claims, 8 Drawing Sheets

FUEL TREATMENT DEVICE USING HEAT AND MAGNETIC FIELD

CROSS REFERENCE TO RELATED APPLICATIONS

This application claims the benefit of a provisional application by the same applicant for the same invention filed in the United States Patent and Trademark Office on Sep. 18, 2008, application No. 61/192,351, as well as the benefit of an amended version thereof filed in the United States Patent and Trademark Office as a provisional application by the same applicant for the same invention on Feb. 27, 2009, application No. 61/208,850, which applications are incorporated herein.

STATEMENT REGARDING FEDERALLY APPROVED RESEARCH OR DEVELOPMENT

None.

APPLICANT

Wayne Roland

BACKGROUND OF THE INVENTION

1. Field of the Invention

This invention relates generally to devices and methods for pre-combustion treatment of hydrocarbon fuels to promote fuel efficiency of internal combustion engines and to reduce engine exhaust pollutants, and more particularly it relates to such devices and methods that apply heat and a magnetic field to fuel as it is supplied through a fuel intake line to a fuel-injected gasoline or diesel internal combustion engine.

2. General Background

Various methods and devices have been disclosed that use one or more permanent magnets to apply a magnetic field to combustible fuel in order to improve combustion efficiency and to reduce engine exhaust pollutants. Flow of liquid, hydrocarbon fuel through a magnetic field, under the right conditions, can promote ionization of components of the fuel and/or an orientation effect on polar molecules in the fuel allowing them to stay in suspension, leading to more complete combustion of fuel in an internal combustion engine. One approach has been to affix permanent magnets to the exterior of a fuel intake line; exemplary of this approach are U.S. Pat. No. 4,188,296 to E. Fujita; U.S. Pat. No. 4,572,145 to J. Mitchell; U.S. Pat. No. 5,124,045 to A. Janczak et al.; and U.S. Pat. No. 5,129,382 to R. Stamps, Sr., et al. A second approach has been to position one or more permanent magnets internally within the fuel intake line so that, during engine operation, fuel streams past the magnets. In the second approach, a ferromagnetic casing has sometimes been provided that surrounded the magnets to help concentrate the magnetic flux lines to the region of fuel flow. Exemplary of the second approach are U.S. Pat. No. 4,050,426 to C. Sanderson; U.S. Pat. No. 4,538,582 to K. Wakuta; U.S. Pat. No. 6,851,413 to R. Tamol, Sr.; U.S. Pat. No. 4,865,730 to B. Lam; and U.S. Pat. No. 7,004,153 to W. Lisseveld. When retrofitting an engine with such magnetic devices, the first approach has the advantage that it does not require severance of the engine fuel intake line to install the device, whereas the second approach does require severance of the fuel line in order to interpose the device within the fuel intake line. On the other hand, the second approach has the advantage that it facilitates a more complete penetration of the flowing fuel by the applied magnetic field, compared to the first approach.

Accordingly, the present invention takes the second approach because experimentation has established that a thoroughly penetrating, very high magnetic flux density—considerably higher than has been advocated by above-referenced disclosures—is important to achieving a significant improvement in fuel combustion efficiency.

Experimentation further established that heating the fuel to a temperature within the range 82° C. (180° F.) to 104° C. (220° F.) prior to, or at the same time as, application of a magnetic field to the fuel, is also important to gain combustion efficiency. In the present invention, whereas only relatively modest improvements in efficiency were obtained from application of a magnetic field to unheated fuel (zero to perhaps 10%), a magnetic field applied to heated, flowing fuel according to the method and apparatus of the invention dramatically and unexpectedly improved fuel efficiency by 40 percent or more. Thus, critical to the success of the invention is the combination of heating the fuel into the required temperature range together with application of a very strong magnetic field to the flowing, heated fuel. It was further determined experimentally that, for maximum combustion efficiency, at least one pair of spaced-apart, permanent magnets are required to create an efficiency-enhancing, magnetic field, which magnets should have their south poles—or alternatively, their north poles—facing toward each other along an axis that is aligned generally with the overall direction of flow of fuel through the magnetic field.

Preheating the fuel or fuel mixture before it entered an engine cylinder for combustion has been proposed in U.S. Pat. No. 4,524,746 E. Hansen; and U.S. Pat. No. 4,672,938 to L. Hoppie et al. More pertinent to the present invention, however, is U.S. Pat. No. 7,478,764 to D. Lee, which disclosed a method and apparatus for reforming a hydrocarbon fuel by application of both heat and a magnetic field to flowing fuel, which was said to lead to improved combustibility and reduction of by-products. Exhaust gases from an engine exhaust manifold were conducted through a reaction vessel. Fuel flowing from a fuel tank through an annular plenum of a fuel injection assembly within the reaction vessel, together with air derived from an air inlet, was heated by the exhaust gases; from there, the fuel-air mixture flowed into an engine intake manifold. Disposed axially within the injection assembly was a reactor rod comprised of materials that are both magnetic as well as catalytic for hydrocarbon cracking. The preheating of the fuel-air mixture was said to completely vaporize the fuel by the time the fuel encountered the reactor rod. The annular plenum had a constrained flow region in order to accelerate the flow rate and thereby increase the velocity and kinetic energy of the fuel molecules, which was said to facilitate cracking of the fuel and formation of plasma, ions and free radicals. An electromagnetic field in and around the reactor rod generated by the flow of the ions was said to cause the reactor rod to develop a magnetic field.

Although hot engine exhaust gases could be used to heat fuel according to the method of the present invention, in a preferred embodiment of the present invention flowing fuel is heated by transfer of heat from hot engine coolant instead because this is generally a more convenient source of heat for this purpose and less costly to install when retrofitting existing internal combustion engines. It is a simple matter of diverting engine coolant to and from the fuel treatment device of the instant invention by suitably sized segments of engine coolant hose. The present invention is further distinguishable from Lee's, in that Lee does not teach the use of north pole-to-north pole nor south pole-to-south pole disposed pairs of magnets of very high magnetic strength to create a magnetic field for treating flowing fuel; nor does Lee's nor any of the other devices and methods known to the applicant apply such a magnetic field to heated fuel that is conducted through the magnetic field in a dual helical path, as described herein below. In further contrast to the present invention, disclosures of prior fuel treatment devices that use a pair of spaced-apart magnets to apply a magnetic field to fuel supplied through a fuel intake line to an internal combustion engine have generally insisted that the magnets should have their opposite poles disposed opposite one another; see, for example, U.S. Pat. No. 7,490,593 to C. Turi, at column 2, lines 34-42. But, it is the combination of heating the fuel to 82° C. (180° F.) to 104° C. (220° F.), together with application to the heated fuel of a magnetic field that is generated by a pair of spaced-apart, same-poles-facing, high strength magnets, in further combination with conducting the heated fuel within the magnetic field through a dual helical pathway, that achieves the significant boost in fuel combustion efficiency that is reported herein.

SUMMARY OF THE INVENTION

The present invention provides a method for treating fuel as it is supplied through a fuel intake line to a fuel-injected, internal combustion engine, in order to increase the fuel combustion efficiency of the engine. The term "combustion efficiency" here refers to the amount of mechanical energy output that the engine provides per unit volume of fuel combusted by the engine when the method is followed, measured either at the engine crankshaft or, especially in the case of motor vehicles, measured by motor vehicle miles driven per liter or gallon of fuel consumed. In a first version of the method, fuel is preheated at a first location to a temperature that is within an optimal temperature range that is experimentally determined for that fuel as providing maximal combustion efficiency. At a second location, the heated fuel passes through a dual helical pathway aligned along a helical axis and, at the same time, the fuel within the pathway is subjected to a magnetic field created by a pair of magnets that are spaced apart at opposite ends of the pathway along the helical axis. The dual helical pathway includes a first tube segment that extends helically about the helical axis from a top end to a bottom end thereof, and a second tube segment, in communication with the first tube segment and coaxial therewith, that extends helically about the helical axis from a bottom end to a top end thereof. When the engine is operating, fuel enters into the top end of the first tube segment and flows to the bottom end thereof, then flows from the bottom end of the second tube segment to the top end thereof; from there, the fuel flows away from the pathway toward the engine fuel injectors. The pair of magnets have either their north poles or their south poles facing each other. The first tube segment substantially surrounds the second tube segment, or vice-versa. As viewed along the helical axis from the top end of the first tube segment, fuel flowing through the first tube segment follows a right-handed helical path, and fuel flowing through the second tube segment as viewed along the helical axis from the bottom end of the second tube also follows a right-handed helical path; alternatively, fuel flowing through the top end to the bottom end of the first tube segment follows a left-handed helical path and fuel flowing through the bottom end to the top end of the second tube segment also follows a left-handed helical path. The heated, magnetic field treated fuel is conducted away from the dual helical pathway toward the engine fuel injectors.

A second version of the method is the same as the first version, except that the heating of the fuel occurs at the same location as, and simultaneously with, conducting the fuel through the dual helical pathway and subjecting the fuel to the magnetic field produced by the pair of magnets. In both versions of the method, the magnets are preferably permanent magnets and must have high flux density.

The present invention further provides a device for treatment of fuel as it is supplied through a fuel intake line to a fuel-injected, internal combustion engine to increase the combustion efficiency of the fuel. The device includes a housing of substantially square, tubular, transverse cross-section that encloses and defines a hollow chamber and has a fuel inlet opening and a fuel outlet opening. The device further includes means attached to the housing at the fuel inlet opening for receiving fuel from the fuel intake line into said fuel inlet opening, and means attached to the housing at the fuel outlet opening and adapted for conducting fuel from the fuel outlet opening toward the engine fuel injectors. The device also includes means attached to the housing for heating the fuel within an optimal temperature range as experimentally determined for maximum efficiency of combustion of the fuel. A bidirectional, dual helical pathway within the chamber includes a first tube segment that communicates with the inlet opening and a second tube segment. The first tube segment extends helically in a first direction about a helical axis from a top end to a bottom end thereof in a first rotational sense—for example, in a right-handed sense. Alternatively, the first and second tube segments both extend helically about the helical axis, but in a second, opposite rotational sense—for example, in a left-handed sense. The top end of the first tube is adapted to receive fuel through the fuel inlet opening for passage through the pathway. The second tube segment extends helically about the helical axis in a second, opposite direction, from a bottom end to a top end thereof in the same, first rotational sense. The bottom end of the second tube segment is continuous, and in communication with, the bottom end of the first tube segment. The top end of the second tube segment preferably is adjacent or near to the top end of the first tube segment. The first and second tube segments preferably comprise steel that is electrolytically-coated with copper. A pair of magnets is disposed along said helical axis within said chamber at opposite ends of the dual helical pathway for subjecting fuel within the dual helical pathway to a magnetic field. The magnets have their north poles or their south poles facing each other, and, preferably, the magnets abut against interior surfaces of the housing and abut against the top and bottom ends of the first and second tube segments.

In a preferred embodiment of the device for use in a water-cooled engine, the housing has a coolant inlet opening and a coolant outlet opening, and the means for heating the fuel within an optimal temperature range includes means attached to the housing in the form of a right-angled, hot water elbow at the coolant inlet opening for receiving coolant from the engine cooling system and means in the form of a right-angled, hot water elbow attached to the housing at the coolant outlet opening for returning coolant back to the cooling system.

It is, therefore, an object of the invention to provide a method for treating fuel as it is supplied through a fuel intake line to a fuel-injected, internal combustion engine in order to increase the fuel combustion efficiency of the engine.

Another object is to provide such a method that simultaneously, or sequentially in time, heats the fuel into a temperature range that is optimal for attaining maximum combustion efficiency, passes the fuel through a dual helical pathway comprised of a first tube segment that extends helically about a helical axis from a top end to a bottom end thereof, and a second tube segment, in communication with the first tube segment and coaxial therewith, that extends helically about the helical axis from a bottom end to a top end thereof, and subjects the fuel within said dual helical pathway to a magnetic field created by a pair of magnets spaced apart at opposite ends of the dual helical pathway and aligned along the helical axis.

A further object of the invention is to provide a device that treats fuel as it is supplied through a fuel intake line to a fuel-injected internal combustion engine in order to increase the fuel combustion efficiency of the engine.

It is still another object of the invention to provide such a device that includes, within a housing of substantially square, tubular, transverse cross-section that encloses and defines a hollow chamber, a dual helical pathway comprised of coaxial, first and second tube segments that extend around a common helical axis and a pair of magnets disposed at, and abutting, opposite ends of the dual helical pathway and aligned along the helical axis.

It is still another object of the invention to provide such a device for a water-cooled, internal combustion engine that includes means attached to the housing for heating fuel within the dual helical pathway to an optimal temperature range by circulating through the chamber hot engine coolant derived from the engine block during engine operation.

The above and other objects and features of the present invention will become apparent from the drawings, the description given herein, and the appended claims.

BRIEF DESCRIPTION OF THE DRAWINGS

Like numerals denote like component parts of the invention throughout the several views.

DETAILED DESCRIPTION OF A PREFERRED EMBODIMENT OF THE INVENTION

The present invention provides a method to increase fuel combustion efficiency in fuel-injected, internal combustion engines within motor vehicles of all kinds, as well as in such engines that power other kinds of equipment, including, for instance, stationary and mobile electric generators. The term "internal combustion engines" as used herein refers to both gasoline engines and diesel internal combustion engines, as well as internal combustion engines that are powered by other kinds of hydrocarbon fuels. I have determined experimentally that, for optimal fuel combustion efficiency, when the fuel is gasoline or diesel fuel, the fuel should be heated to a temperature range of 82° C. (180° F.) to 104° C. (220° F.) The term "diesel" as used here refers to petroleum diesel, not biodiesel. Other kinds of liquid, hydrocarbon fuels, however, such as azeotropic ethanol, ethanol-gasoline mixtures, biodiesel and biodiesel/petroleum diesel blends may combust optimally according to the method and device of the invention in an alternative, experimentally-determinable, temperature range, and. in that case, the fuel should be heated to that alternative temperature range.

Figure 1A:
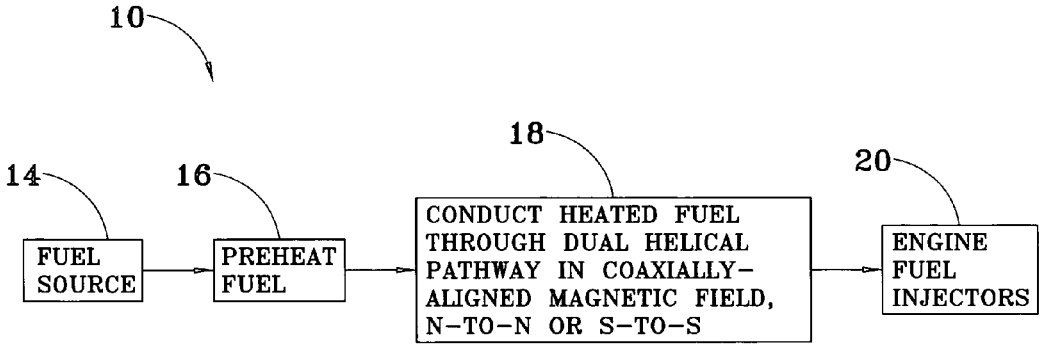
FIG. 1A is a schematic diagram of a method for increasing fuel combustion efficiency in a fuel-injected internal combustion engine, wherein the fuel is heated prior to subjecting the fuel to a magnetic field.
Figure 1B:
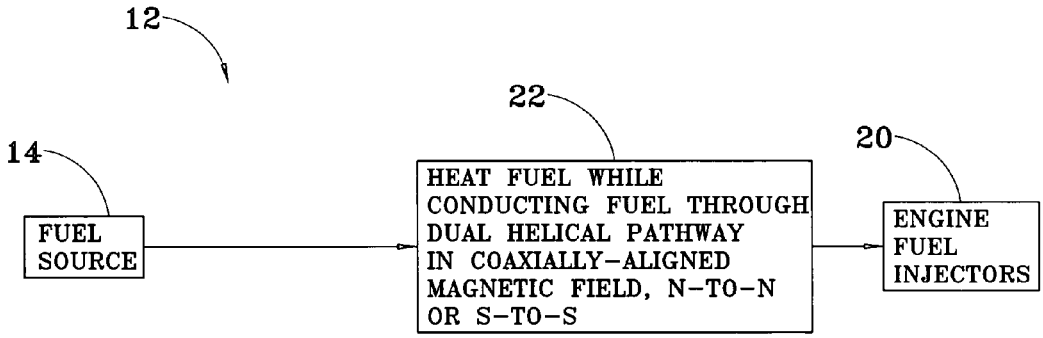
FIG. 1B is a schematic diagram of an alternative method for increasing fuel combustion efficiency, wherein the fuel is heated at the same time and location as it is subjected to a magnetic field.
Figure 2:
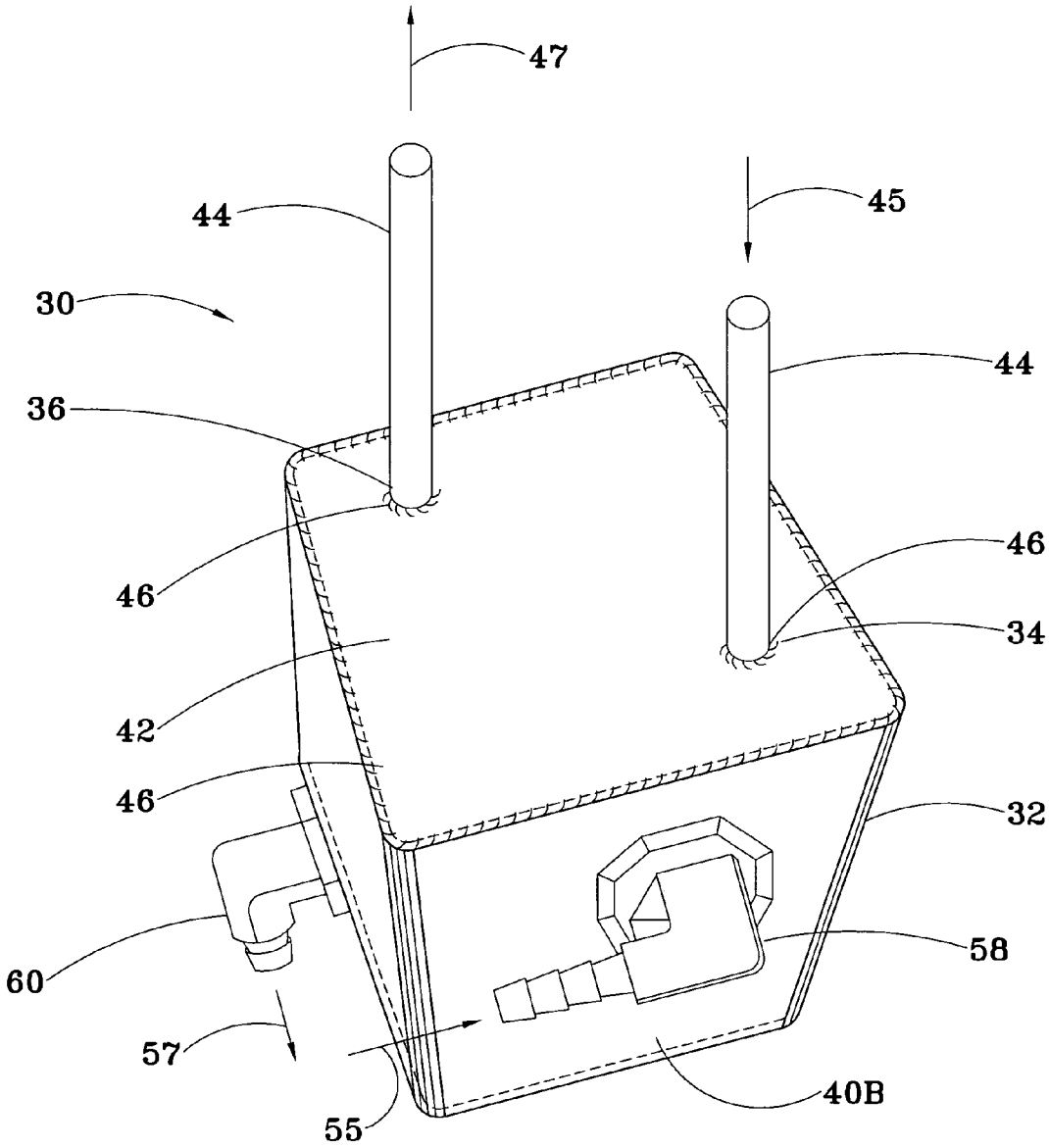
FIG. 2 is a frontal, perspective view of a preferred embodiment of a device for implementing the alternative method of FIG. 1B.
Figure 3:
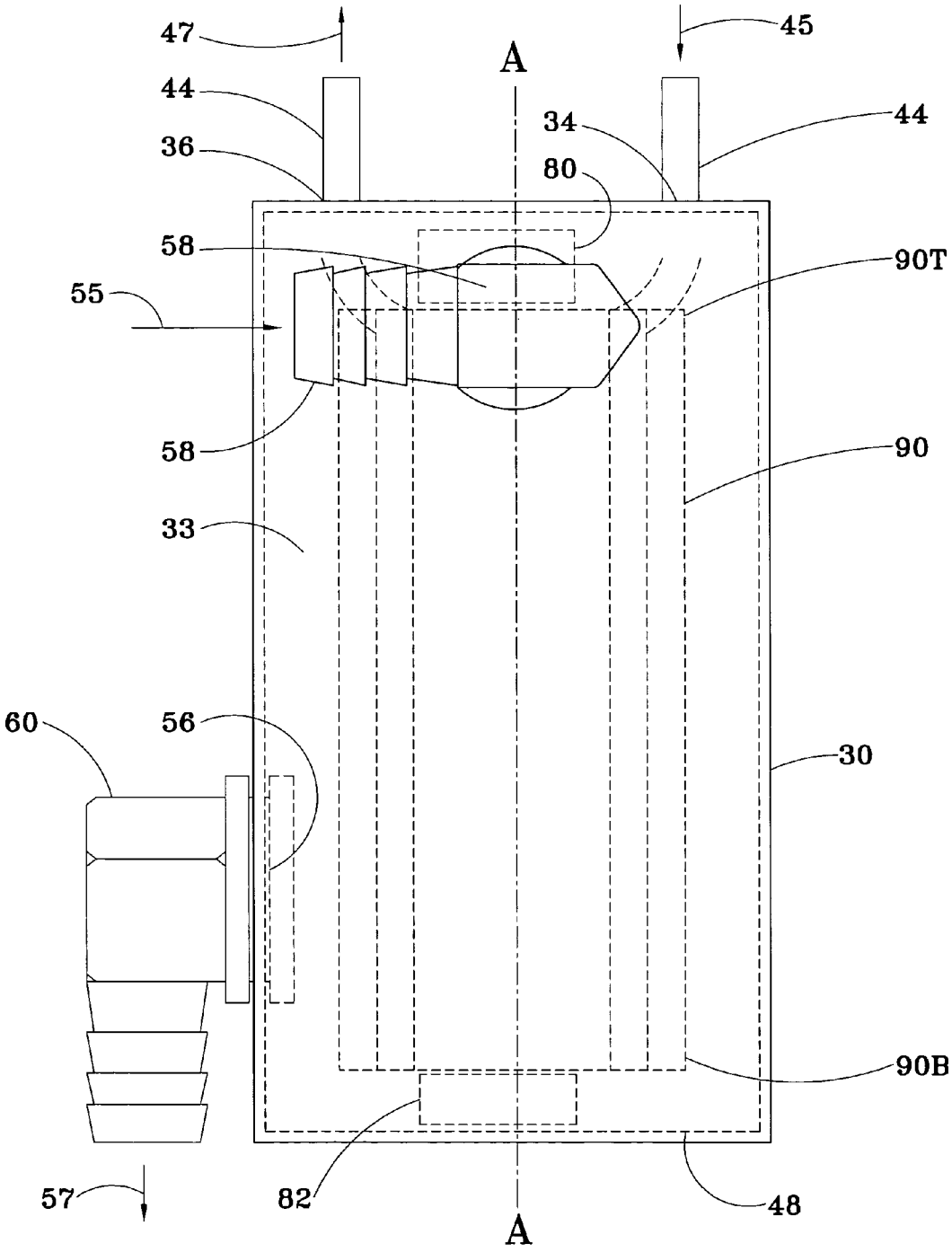
FIG. 3 is a front, elevational view thereof.
Figure 4:
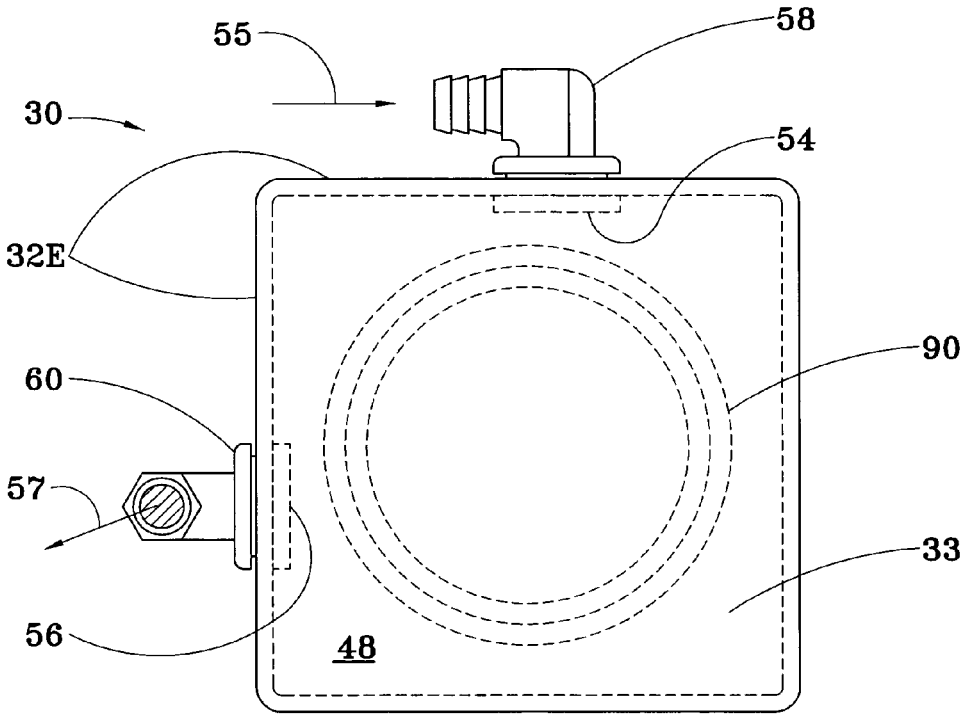
FIG. 4 is a bottom plan view thereof.

FIGS. 1A and 1B schematically illustrate alternative ways to implement the method of the invention for improving fuel combustion efficiency. The first method, illustrated in FIG. 1A and denoted generally by the numeral 10, comprises a first step 14 of feeding fuel from a fuel source, which would typically be stored fuel within a fuel tank, a second step 16 of preheating the fuel, a third step 18 of conducting the heated fuel through a dual helical pathway in a coaxially-aligned magnetic field, and a fourth step 20 of conducting the fuel to engine fuel injectors. The second method, illustrated in FIG. 1B and denoted generally by the numeral 12, is identical to the first method except that the step 16 of preheating the fuel is eliminated; instead, the fuel is heated at the same time and in the same location as the place where the fuel is conducted through a dual helical pathway in a coaxially-aligned, magnetic field. Thus, the second method 12 comprises a first step 14 of feeding fuel from a fuel source, a second step 22 of heating the fuel while at the same time conducting the fuel through a dual helical pathway in a coaxially-aligned magnetic field, and a third step 20 of conducting the fuel to engine fuel injectors. For both methods 12, 14, the source of heat for heating the fuel will ordinarily be heat generated during operation of the engine that is combusting the fuel—heated circulating coolant in the case of water-cooled engines or engine exhaust heat, for instance—but any source of heat that will raise the temperature of the fuel into a temperature range for optimal fuel combustion efficiency will suffice. The meaning of the terms "dual helical pathway" and "coaxially-aligned, magnetic field, N-to-N or S-to-S" in FIGS. 1A and 1B will become apparent from the discussion below and the accompanying figures.

The engine compartments of modern motor vehicles tend to be somewhat cramped, so that it is desirable to economize on the space required to carry out the steps of the methods 12, 14. Accordingly, at least for motor vehicle applications, the second method 14 is preferred because the space within which the fuel is heated is substantially the same space within which the fuel is conducted through a dual helical pathway and subjected to a magnetic field. A preferred embodiment of a device for performing the steps of the second method 12 is described below and illustrated in FIGS. 2-7.

Figure 5B:
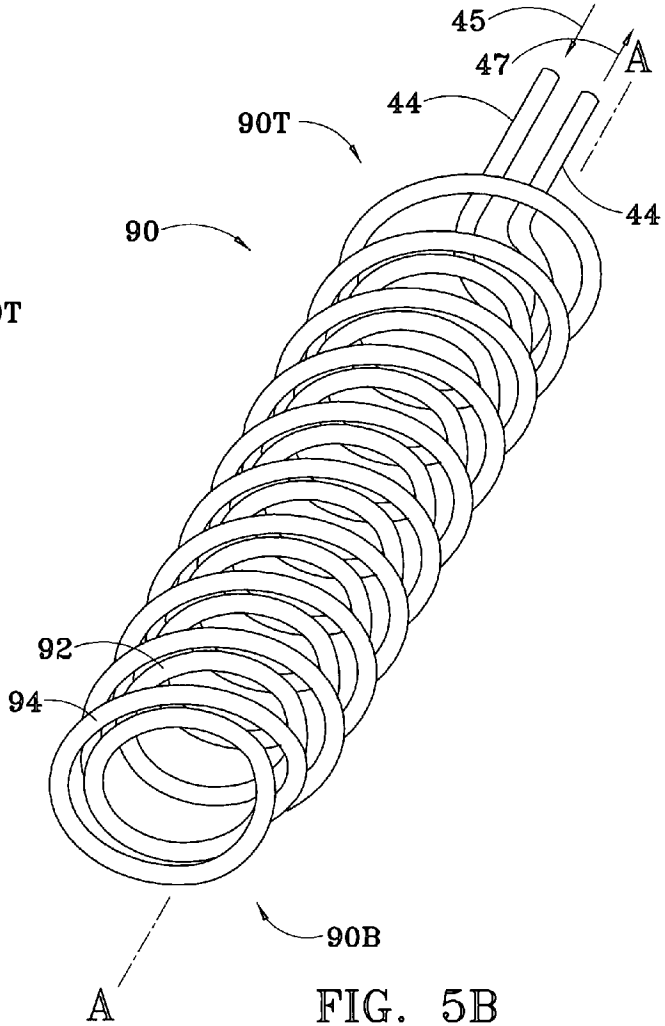
FIG. 5B is a repeat of FIG. 5A, except that a reverse fuel flow situation is illustrated, wherein fuel received from a fuel source first flows through the external tube segment and thence through the internal, tube segment of the dual helical pathway.
Figure 5A:
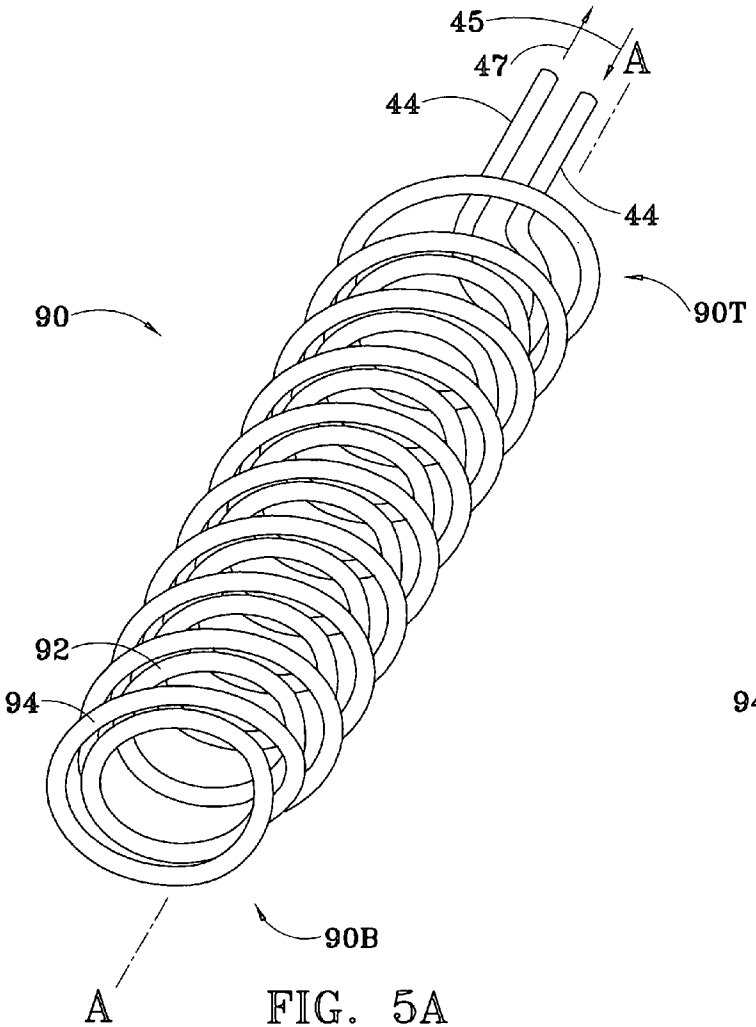
FIG. 5A is a perspective view of a preferred embodiment of a dual helical pathway removed from said device for clarity of illustration, which pathway includes a helical, internal, tube segment that is joined to, and in communication with, a helical, external, tube segment that surrounds and is coaxial with the internal, tube segment, so that, during engine operation, fuel from a fuel source flows first through the internal tube segment and thence through the external tube segment.
Figure 6:
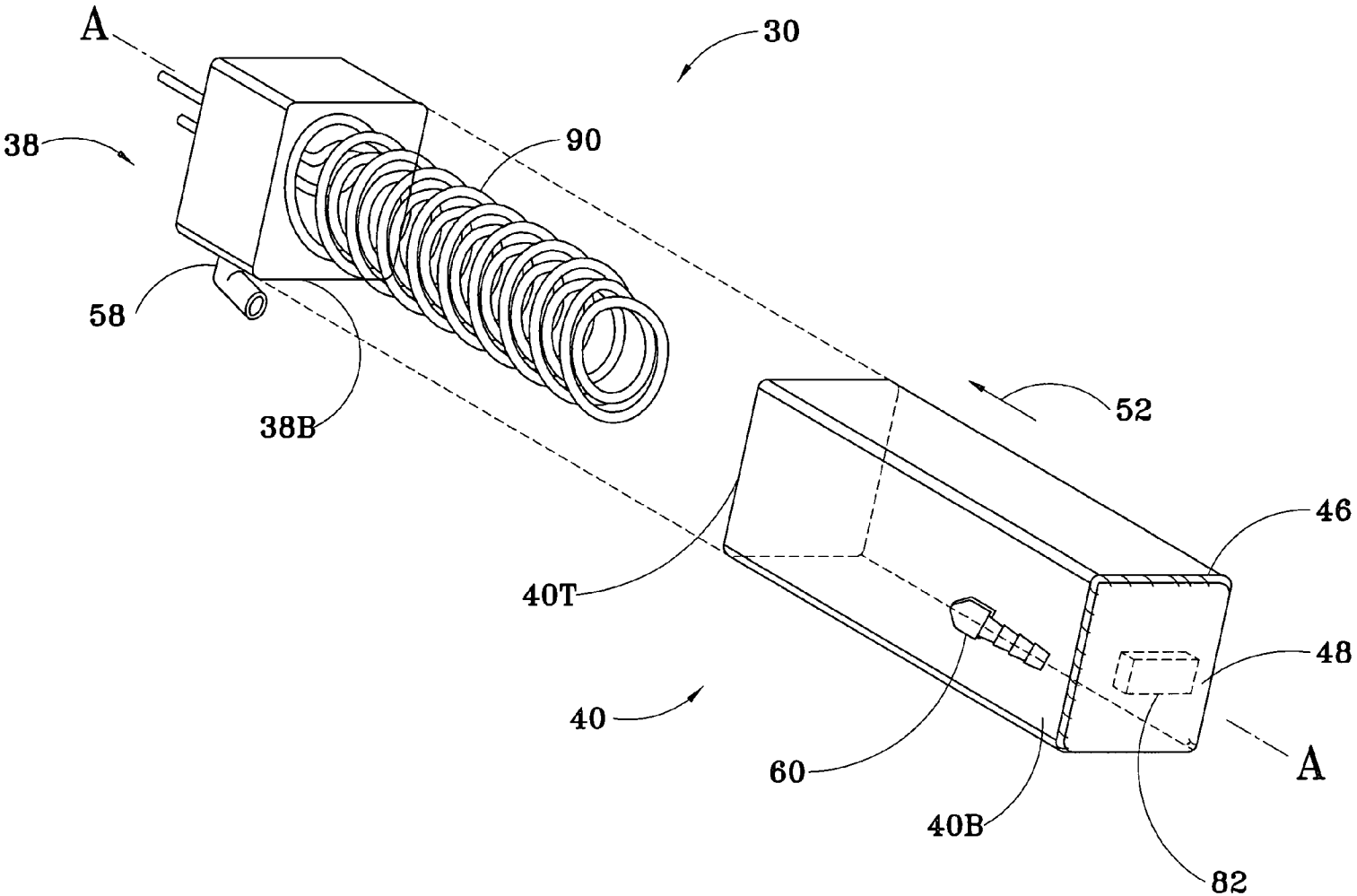
FIG. 6 is an exploded view of the device.

FIGS. 2-6 depict a preferred embodiment of a device 30 for carrying out the steps of the second method 12 for a water-cooled, fuel-injected gasoline or diesel internal combustion engine. The device 30 includes a housing 32 comprising a magnetizable metal, preferably steel, that encloses a hollow chamber 33. The housing 32 has a relatively short, square tubular base portion 38 and a longitudinally-elongated, square tubular, cover portion 40 having a transverse, square cross-section that matches the transverse, square cross-section of the base portion, as best seen in FIG. 6. The base portion 38 extends longitudinally from a square, top end plate 42 to a square, open, bottom margin 38B. The top end plate 42 has a fuel inlet opening 34 and a fuel outlet opening 36 that communicate with the chamber 32. Two fuel line tubes 44, 44' protrude through the top end plate 42 away from the base margin 38B, and are seal welded to the top end plate by seal welds 46; the tube 44 serves as a means for receiving fuel (arrow 45) from a fuel pump 50, and tube 44' serves as a means for conducting fuel toward (arrow 47) engine fuel injectors (not shown). A bottom end 40B of the cover portion 40 is closed off by a square, bottom end plate 48 seal-welded thereto, but an opposite, top end 40T is open until the device is fully assembled and the cover portion 40 is moved (arrow 52) into engagement with the base portion 38, and the bottom margin 38B is seal-welded to the open, top end 40T of the cover portion 40. Preferably, the entire exterior surface 32E of the housing 32 is painted white.

The housing 32 has a coolant inlet opening 54 and a coolant outlet opening 56. A first, right-angled, hot water elbow 58 is attached to an exterior surface of the housing 32 at the coolant inlet opening 54 near the top end plate 42, and a second, right-angled, hot water elbow 60 is attached to an exterior surface of the housing 32 at the coolant outlet opening 56. The first and second elbows 58, 60 serve as means for receiving hot coolant into the device 30 (arrow 55) from the engine cooling system during engine operation, and as means for returning coolant back to the cooling system (arrow 57) from the device, respectively. The elbows 58, 60 are in communication with the chamber 33 and are attached to the engine cooling system by hoses 60 and hose clamps (not shown), so that during engine operation there is a continuous flow of heated coolant through the chamber for providing heat to the fuel. Ring seals (not shown) are provided for each of the elbows 58, 60 to prevent coolant from leaking out of the housing 32 through the openings 54, 56, and the elbows are rotatable within those openings to facilitate orienting them for connection to engine cooling system hoses 60.

In a preferred embodiment of the device 30, the dual helical pathway 90 extends longitudinally from a top end 90T to a bottom end 90B and comprises a first, internal, helically coiled tube segment 92 joined to, and in communication with, a second, external, helically coiled tube segment 94 that substantially surrounds the internal coiled tube segment, as best seen in FIGS. 5A and 5B. The tube segments 92, 94 are coaxial about a helical axis A-A. A top end of the internal tube segment 92 is attached to, and in communication with, a fuel intake tube 44, and a top end of the external tube segment 94 is attached to, and in communication with, a fuel outlet tube 44', as depicted in FIG. 5A. Alternatively, a top end of the external tube segment 94 is attached to, and in communication with, a fuel intake tube 44, and a top end of the internal tube segment 94 is attached to, and in communication with, a fuel outlet tube 44', as depicted in FIG. 5B. As depicted in FIGS. 5A, 5B and 6, and as viewed along the helical axis A-A from the top end 90T toward the bottom end 90B of the pathway 90 (i.e., the overall direction of fuel flow through the internal tube segment 92), the rotational sense of the internal tube segment 92 is right-handed. Likewise, as viewed along the helical axis A-A from the bottom end 90B toward the top end 90T (i.e., the overall direction of fuel flow through the external tube segment 94), the rotational sense of the external tube segment 94 is also right-handed. It will be understood, however, that the rotational sense of both tube segments 92, 94, when viewed this same way, could equally well be reversed (not shown) from that shown in FIGS. 5A, 5B and 6—namely, left-handed rotational sense for both.

Figure 7:
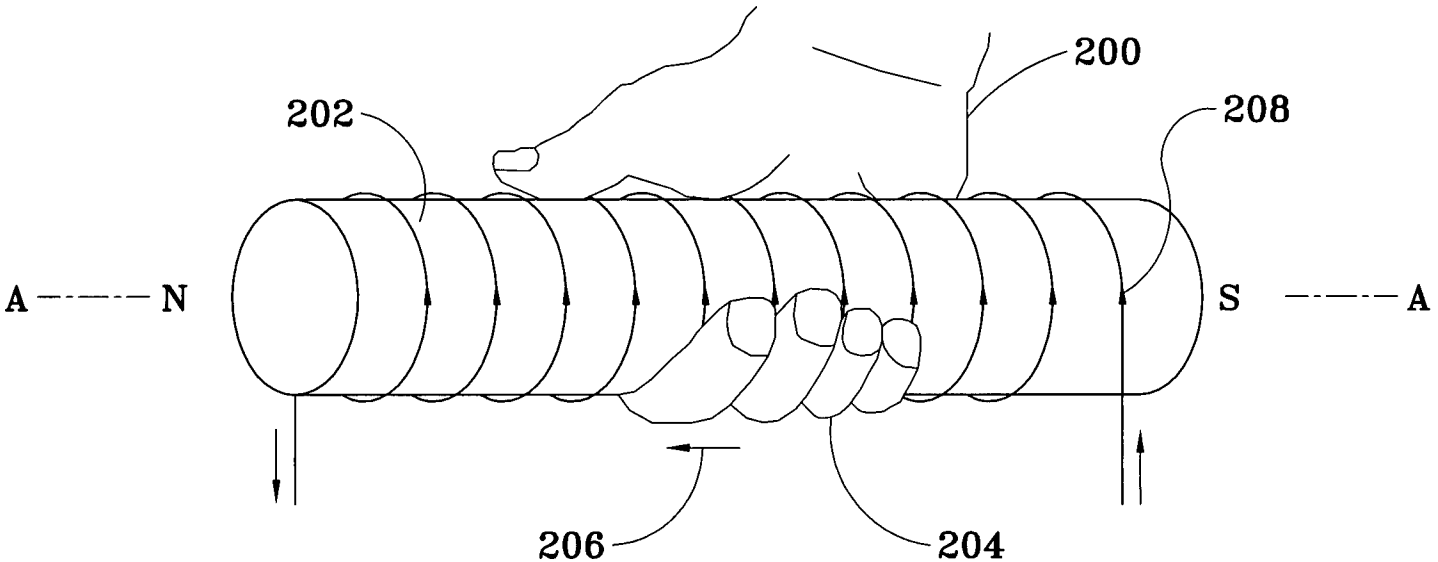
FIG. 7 illustrates application of the right-hand grip rule to determine the magnetic field direction of a coil, wherein a helical coil is depicted as wound about a helical axis A-A in a right-handed sense and electric current progresses through the coil in the direction of the illustrated thumb.

Flow of electric current through a helical coil induces a magnetic field. FIG. 7 illustrates the right-hand grip rule, which states that, if one's right hand 200 grasps an electrically-conductive, helical coil 202 wound in a right-handed, rotational sense about a helical axis A-A such that the thumb points in the overall direction of electric current flow (arrow 206) through the coil, and the fingers 204 of the right hand align with the direction of current flow (arrows 208) through the windings of the coil, the thumb will point in the direction of the north pole N of the magnetic field induced by electric current flow through the coil. The right-hand grip rule can be applied to flow of fuel through the dual helical pathway 90, as follows. When fuel flow is as depicted in FIG. 5A, as the fuel proceeds through the right-handed helical coil of the internal tube segment 92 from the top end 90T toward the bottom end 90B, any ionized components of the fuel induce a magnetic field directed from the top end toward the bottom end; whereas, as the fuel flows through the right-handed helical coil of the second tube segment 94 from the bottom end 90B toward the top end 90T, ionized components of the fuel induce a magnetic field that is directed from the bottom end toward the top end. The dual helical tube segments 92, 94, therefore, subject flowing fuel to a pair of induced, opposed magnetic fields. To enhance the applied and induced magnetic fields, the entire dual helical pathway and the inlet and outlet tubes 44 are preferably made of magnetically-susceptible steel that is electrolytically-coated with copper.

The device 30 further includes a first, permanent magnet 80 disposed near the coolant inlet opening 54 at an interior surface of the top end plate 42 of the housing 32 and a second, permanent magnet 82 disposed near the coolant outlet opening 56 at an interior surface of the bottom end plate 48 of the housing. Preferably, the first and second magnets 80, 82 are magnetically attached to interior surfaces of the top and bottom end plates 42, 48, respectively. The north poles N of the magnets 80, 82 are disposed facing each other; alternatively, the south poles S of the magnets 80, 82 are disposed facing each other. The magnets 80, 82 provide a pair of applied, opposed magnetic fields and define a magnetic field axis that extends through the first and second magnets. For the device 30 to provide optimal combustion efficiency, the magnets 80, 82 should each provide high flux density, and the magnets should be aligned upon the helical axis A-A of the dual helical pathway 90. In a preferred embodiment of the device 30, each of the magnets 80, 82 has flux density of 76,000 gauss and is a neodymium magnet, but other kinds of magnets with equivalent flux density could be substituted.

Figure 8:
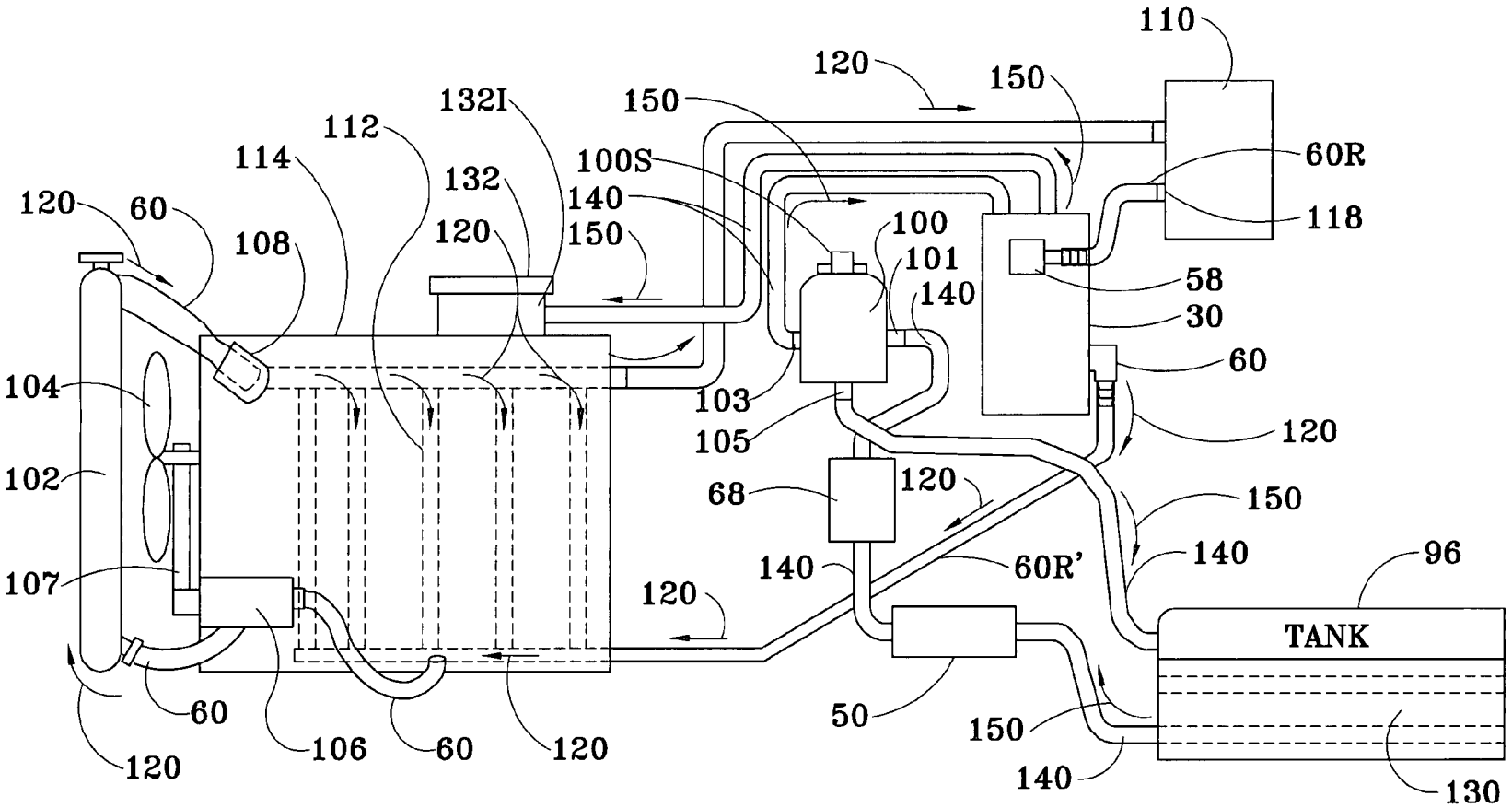
FIG. 8 is a schematic diagram of a preferred embodiment of the device of the present invention, showing connections of the device to engine and other motor vehicle components.

FIG. 8 illustrates schematically the manner in which the device 30 can be attached to an engine cooling system and fuel intake line system of a motor vehicle equipped with a fuel-injected, internal combustion engine. In FIG. 8, original equipment cooling system components are connected into a coolant circulating system by cooling system hoses 60 and include a radiator 102 containing liquid coolant, a cooling fan 104 for air cooling the radiator, a water pump 106, which, like the fan, is powered by a belt 107 driven by the engine crankshaft (not shown), a thermostat 108 for controlling the rate of flow of coolant through the cooling system to maintain a desired engine operating temperature, and a heater 110 for heating the passenger spaces of the vehicle. The coolant is an aqueous mixture containing antifreeze. The pump 106 drives coolant through the radiator 102, thence through the thermostat 108 and into coolant passageways 112 within the engine block 114 (depicted by phantom lines), and coolant returns from the block to the pump. Coolant also flows from the block 114 via a hose 60 through an inlet port 116 of a passenger space heater 110; but, the original return hose 60R that conducted coolant from an outlet port 118 of the heater has been severed, and the device 30 has been inserted into the coolant return line by attachment of a first hose 60R to the first hot water elbow 58, and a second hose 60R' has been attached to the second hot water elbow 60 in order to return coolant from the device 30 back to the engine block 114; see arrows 120. During engine operation, an original equipment fuel pump 50 pumps stored fuel 130 from a fuel tank 96 through a fuel line hose 140 into and through a fuel filter 68, and thence into a first inlet/outlet port 101 of an original equipment or aftermarket adjustable pressure regulator 100; see arrows 150. The regulator 100 also has a second inlet/outlet port 103 and a fuel return port. 105. The regulator 100 further includes a fuel pressure adjusting screw 100S, which can adjust a reference pressure up or down, such that the regulator permits fuel to flow between the first and second inlet/outlet ports 101, 103 only when fuel line pressure is less than the reference pressure; otherwise, the fuel is shunted through the fuel return port 105 for return through a fuel line hose 140 to the fuel tank 130. In combination, the tank 96, fuel pump 50, fuel filter 68, regulator 100 (if present) and associated fuel line hoses 140 comprise a fuel intake line.

Prior to installation of the device 30, the second inlet/outlet port 103 was attached by a fuel line hose 140 directly to an inlet port 132I of a fuel intake unit 132 mounted to the block 114 for feeding fuel to fuel injectors therein (not shown). That fuel line hose 140 has been severed, however, and the device 30 has been inserted within that fuel line by connecting the filter 60 via a fuel line hose 140 to an inlet tube 44 of the device, and by connecting an outlet tube 44' of the device via a fuel line hose 140 to the inlet port 132I. Accordingly, all original equipment of the motor vehicle has been left intact, except for severing the cooling system hoses 120 and the fuel line hoses 140 in order to install the device 30. The installation of the device 30 as described herein and depicted in FIG. 8 is by way of example only because the cooling and fuel line systems of motor vehicles differ in detail, so that the manner and location of installation of the device will necessarily vary in ways that will be apparent to persons of ordinary skill in the art. It is, of course, necessary to securely attach the device 30 within the engine compartment of a motor vehicle with appropriate mounting brackets (not shown), dimensioned and shaped to suit the available space and configuration of the engine compartment. For optimum fuel combustion efficiency, the engine thermostat 108 should maintain the temperature of the coolant in the optimal temperature range, which for gasoline and diesel-powered engines is 82° C. (180° F.) to 104° C. (220° F.). For a gasoline engine installed in an automobile, pickup truck, and the like, the housing 32 preferably has a 8.9 cm (3.5 inch) by 8.9 cm (3.5 inch), square cross-section and length of 17.8 cm (7 inch), more or less, with the other components of the device dimensioned to fit therein. For a diesel engine installed in an automobile, truck or heavy equipment vehicles such as graders and the like, the housing 32 has a 12.7 cm (5 inches) by 12.7 cm (5 inches), square cross-section and length of 35.6 cm (14 inches), more or less, with the other components of the device dimensioned to fit therein.

The foregoing disclosure and description of the invention is illustrative and explanatory thereof, and various changes with respect to the size, shape, and materials, as well as in the details of the illustrated construction may be made without departing from the spirit of the invention, and therefore fall within the scope of the appended claims even though such variations were not specifically discussed above.

I claim

1. A method for increasing the combustion efficiency of fuel in a fuel-injected, internal combustion engine, said engine having a fuel intake line that conducts fuel from a fuel source to one or more fuel injectors of said engine, comprising the steps of:

preheating the fuel at a first location intermediate said fuel source and said fuel injectors to a temperature within an optimal temperature range as experimentally determined for maximum efficiency of combustion of said fuel when said fuel is combusted according to said method, thereby producing preheated fuel;

at a second location intermediate said fuel source and said fuel injectors, conducting said preheated fuel through a bidirectional, dual helical pathway disposed within a housing comprising a magnetically-susceptible metal, wherein said pathway includes a first tube segment comprising a magnetically-susceptible metal that extends helically about a helical axis from a top end to a bottom end thereof in a first rotational sense, said top end receiving fuel into said pathway; and a second tube segment comprising a magnetically-susceptible metal that extends helically about said helical axis from a bottom end to a top end thereof in said first rotational sense, said bottom end of the second tube segment being continuous and in communication with the bottom end of the first tube segment, and said top end of said second tube segment being adjacent or near to the top end of the first tube segment;

at said second location, at the same time that the preheated fuel is being conducted through said dual helical pathway, subjecting said preheated fuel to a magnetic field, wherein said magnetic field is created by first and second magnets spaced apart along said helical axis on opposite ends of said pathway and abutting opposite, interior surfaces of said housing;

said dual helical pathway is coaxially disposed between said magnets, said first and second magnets have either their north poles or their south poles facing each other; and conducting the preheated, magnetic field treated fuel from the top end of the second tube segment to said one or more fuel injectors.

2. The method of claim 1, wherein the first magnet abuts the top end of the first tube segment and/or abuts the top end of the second tube segment, and the second magnet abuts the bottom end of the second tube segment and/or abuts the bottom end of the first tube segment.

3. The method of claim 1, wherein the second tube segment substantially surrounds the first tube segment.

4. The method of claim 1, wherein the first tube segment substantially surrounds the second tube segment.

5. The method of claim 1, wherein the first and second locations are identical locations such that preheating the fuel, subjecting the heated fuel to said magnetic field, and conducting said heated, magnetic field treated fuel through a dual helical pathway all occur at the same location.

6. The method of claim 1, wherein the fuel is gasoline or diesel fuel and the optimal temperature range is 82° C. (180° F.) to 104° C. (220° F.).

7. The method of claim 6, wherein the first and second tube segments are comprised of steel.

8. The method of claim 7, wherein the exterior surfaces of the first and second tube segments are electrolytically-coated with copper.

9. The method claim 8 wherein said engine has an engine cooling system that conducts coolant through the engine, whereby, when said engine is operating, said coolant is heated into the optimal temperature range, further comprising the step of conducting said coolant to said first location to heat said fuel to said temperature range.

10. The method of claim 9, wherein said engine is equipped with a fuel pump and an adjustable pressure regulator interposed between the fuel pump and the one or more fuel injectors, said regulator having an inlet port for receiving fuel from the fuel pump, an outlet port for sending fuel toward the one or more fuel injectors, a fuel return port for returning fuel toward the fuel source whenever said regulator senses that pressure in the fuel intake line exceeds an adjustable pressure threshold, and a fuel pressure adjusting screw for adjusting said pressure threshold up or down, further comprising the steps of:

conducting fuel from the fuel pump to said inlet port;

conducting fuel from said outlet port to the dual helical pathway; and conducting fuel from the fuel return port back to the fuel source whenever the pressure in the fuel intake line exceeds said threshold.

11. The method of claim 10, further comprising the step of adjusting said fuel pressure adjusting screw to make said pressure threshold as low as possible consistent with smooth and dependable operation of the engine.

12. The method of claim 1, wherein the housing is square in transverse cross-section.

13. A device for treatment of fuel as it is supplied through a fuel intake line to a fuel-injected, internal combustion engine to increase the efficiency of combustion of the fuel, said engine having a fuel source and a fuel intake line that conducts fuel from the fuel source through a fuel pump to one or more engine fuel injectors, comprising:

a housing comprising a magnetically-susceptible metal, wherein said housing encloses and defines a hollow chamber and has a fuel inlet opening and a fuel outlet opening;

means attached to the housing at the fuel inlet opening for receiving fuel from the fuel intake line into said fuel inlet opening;

means attached to the housing at the fuel outlet opening and adapted for conducting fuel from the fuel outlet opening toward the one or more fuel injectors;

means attached to the housing for heating the fuel within an experimentally-determinable, optimal temperature range for maximum efficiency of combustion of said fuel, thereby producing heated fuel;

a bidirectional, dual helical pathway disposed within the chamber, said pathway including a first tube segment comprising a magnetically-susceptible metal that extends helically about a helical axis in a first direction from a top end to a bottom end thereof in a first rotational sense, said top end being adapted to receive fuel through said fuel inlet opening into said pathway; and a second tube segment comprising a magnetically-susceptible metal that extends helically about said helical axis in a second, opposite direction from a bottom end to a top end thereof and in the said first rotational sense, said bottom end of the second tube segment being continuous and in communication with the bottom end of the first tube segment, and said top end of said second tube segment being adjacent or near to the top end of the first tube segment;

first and second magnets disposed along said helical axis within said chamber at opposite ends of said pathway and abutting opposite interior surfaces of said housing for subjecting fuel within said dual helical pathway to a magnetic field, wherein said magnets have their north poles or their south poles facing each other.

14. The device of claim 13, wherein the magnets are permanent magnets, and each magnet has 76,000 gauss or more flux density.

15. The device of claim 14, wherein the first magnet abuts the top end of the first tube segment and/or abuts the top end of the second tube segment, and the second magnet abuts the bottom end of the second tube segment and/or abuts the bottom end of the first tube segment.

16. The device of claim 15, wherein the engine has a cooling system that circulates a liquid coolant through the engine block during engine operation, thereby heating the coolant into the optimal temperature range, the housing has a coolant inlet opening and a coolant outlet opening that are in communication with the chamber, and the means for heating the fuel includes means attached to the housing at the coolant inlet opening for receiving coolant from the cooling system, and means attached to the housing at the coolant outlet opening for returning coolant back to the cooling system.

17. The device of claim 16, wherein said means for receiving coolant and said means for returning coolant each include a right-angled, hot water elbow attached to an exterior surface of the housing at the coolant inlet opening and the coolant outlet opening, respectively.

18. The device of claim 17, wherein the housing has a substantially square, tubular cross-section normal to the flow of coolant through the housing.

19. The device of claim 18, wherein the housing comprises steel, and the external and internal tube segments of said dual helical pathway comprise steel tubing electrolitically-coated with copper.

20. A device for treatment of fuel as it is supplied through a fuel intake line to a fuel-injected, internal combustion engine to increase the efficiency of combustion of the fuel, said engine having a fuel tank and a fuel intake line that conducts fuel from a fuel tank to one or more engine fuel injectors and a cooling system that circulates a liquid coolant through the engine block during engine operation, comprising:

a housing, wherein said housing comprises a magnetically-susceptible metal and encloses and defines a hollow chamber, and said housing has a fuel inlet opening, a fuel outlet opening, and a coolant inlet opening and a coolant outlet opening that are in communication with the chamber, a first, right-angled, hot water elbow attached to an exterior surface of the housing at the coolant inlet opening for conducting coolant into the chamber;

a second, right-angled, hot water elbow attached to an exterior surface of the housing at the coolant outlet opening for conducting coolant out of the chamber;

means attached to the housing at the fuel inlet opening for receiving fuel from the fuel intake line into said fuel inlet opening;

means attached to the housing at the fuel outlet opening for conducting fuel from the fuel outlet opening toward the one or more fuel injectors;

a bidirectional, dual helical pathway comprised of a magnetically-susceptible metal and disposed within the chamber, said pathway including a first tube segment that extends helically about a helical axis from a top end to a bottom end thereof, said top end being adapted to receive fuel through said fuel inlet opening into said pathway; and a second tube segment that extends helically about said helical axis from a bottom end to a top end thereof, said bottom end of the second tube segment being continuous and in communication with the bottom end of the first tube segment, and said top end of said second tube segment being adjacent or near to the top end of the first tube segment; and first and second permanent magnets disposed along said helical axis within said chamber at opposite ends of said pathway for subjecting fuel within said dual helical pathway to a magnetic field, wherein said magnets have their north poles or their south poles facing each other, and the magnets abut interior surfaces of the housing.

21. The device of claim 20, wherein the housing is comprised of steel;

the dual helical pathway is comprised of steel that is electrolytically-coated with copper;

the first magnet abuts a top end of the first tube segment and/or a top end of the second tube segment;

the second magnet abuts a bottom end of the first tube segment and/or a bottom end of the second tube segment;

the first tube segment extends helically about the helical axis from a top end to a bottom end thereof in a first, rotational sense, and the second tube segment extends helically about said helical axis from a bottom end to a top end thereof also in said first, rotational sense.

22. The device of claim 21, wherein the first and second magnets each have flux density of 76,000 gauss or more.

23. The device of claim 21, wherein the first, rotational sense is a right-handed, rotational sense.

24. The dev ice of claim 21, wherein the first, rotational sense is a left-handed, rotational sense.

25. The device of claim 21, wherein the second tube segment substantially surrounds the first tube segment.

26. The device of claim 21, wherein the first tube segment substantially surrounds the second tube segment.

* * * * *